US007108219B2

(12) United States Patent
Fiedler

(10) Patent No.: US 7,108,219 B2
(45) Date of Patent: Sep. 19, 2006

(54) WINDER APPARATUS WITH TRANSFER BRUSH ROLL

(75) Inventor: Lee Fiedler, Denmark, WI (US)

(73) Assignee: Hudson-Sharp Machine Company, Green Bay, WI (US)

( * ) Notice: Subject to any disclaimer, the term of this patent is extended or adjusted under 35 U.S.C. 154(b) by 257 days.

(21) Appl. No.: 10/810,366

(22) Filed: Mar. 26, 2004

(65) Prior Publication Data

US 2005/0211818 A1 Sep. 29, 2005

(51) Int. Cl.
*B65H 19/30* (2006.01)

(52) U.S. Cl. ..... 242/533.4; 242/532.2; 242/535.4

(58) Field of Classification Search ..... 242/530.1, 242/533.4, 535.4, 532.2, 547, 548, 532, 532.7
See application file for complete search history.

(56) References Cited

U.S. PATENT DOCUMENTS 4,077,580 A * 3/1978 Lang et al. ..... 242/554.2
4,667,890 A * 5/1987 Gietman, Jr. ..... 242/532.2
4,846,417 A * 7/1989 Muller et al. ..... 226/92
5,318,237 A * 6/1994 Lotto et al. ..... 242/532.2
5,337,968 A * 8/1994 De Bin et al. ..... 242/521
5,570,878 A * 11/1996 Lotto et al. ..... 271/203
5,588,644 A * 12/1996 Lotto et al. ..... 271/183
5,779,180 A * 7/1998 Smedt et al. ..... 242/528
5,899,403 A * 5/1999 Gietman et al. ..... 242/528
6,739,544 B1 * 5/2004 Yuuki et al. ..... 242/541.6

* cited by examiner

*Primary Examiner*—John Q. Nguyen
*Assistant Examiner*—Sang Kim
(74) *Attorney, Agent, or Firm*—Wood, Phillips, Katz, Clark & Mortimer

(57) ABSTRACT

A winder apparatus for winding webs of material into rolls includes a conveyor, and a winding turret with a plurality of rotatably driven winding spindles thereon. The winding turret indexes the winding spindles relative to the apparatus conveyor, with each spindle moved to a transfer position wherein a web of material is transferred from the conveyor onto the spindle to initiate roll formation. A rotatably driven transfer brush assembly is positionable in operative association with the conveyor and the spindle in the winding position to facilitate efficient and consistent transfer of a web from the conveyor onto the spindle for roll formation.

12 Claims, 3 Drawing Sheets

WINDER APPARATUS WITH TRANSFER BRUSH ROLL

TECHNICAL FIELD

The present invention relates generally to an apparatus for winding webs of material into individual rolls, and more particularly to a winder apparatus having a brush roll assembly which facilitates efficient transfer of serially conveyed webs of material onto associated winding spindles of the apparatus.

BACKGROUND OF THE INVENTION

Automated winding machines facilitate efficient, high-speed winding of webs of materials, such as interleaved or connected plastic film bags, into individual rolls. An apparatus of this nature includes a conveyor along which the webs of material are serially conveyed, and an associated, indexable winding turret having a plurality of winding spindles mounted thereon. The spindles of the winding turret can each be indexed to a so-called transfer position, with winding of a roll initiated by transferring a leading edge portion of one of the material webs onto the winding spindle. The spindle is rotatably driven in coordination with speed at which the webs are conveyed, thereby forming a coreless roll on the spindle. When the roll is completed, another spindle is presented at the transfer position for winding, while rolls previously formed on the turret spindles are moved at a discharge position through which the spindles are indexed.

U.S. Pat. No. 5,779,180, hereby incorporated by reference, discloses a drive arrangement for effecting drive of the winding spindles, with a typical winder apparatus exemplified by commercially available Hudson-Sharp M-450 continuous motion winder.

Heretofore, operation of such a winder apparatus can inadvertently result in mis-transfer of one of the webs of material, that is, failure to initiate the intended winding of the web onto the winding spindle at the transfer position. Naturally, such mis-transfers undesirably results in wasted product and undesirable down time for the equipment.

Heretofore, initiation of web winding has been effected by the provision of an air horn which acts upon the leading portion of the web of material to effect transfer to the associated winding spindle in the transfer position. A air blast from the air horn is precisely timed so as to direct air at the web on the conveyor, forcing the web off of the conveyor and around the winding spindle which is positioned in operative association with the air horn.

As noted, this existing transfer arrangement can sometimes undesirably result in mis-transfer of the webs of material. Additionally, this particular component of the winding apparatus is a relatively expensive part to fabricate, entailing substantial machine work for its manufacture.

The present invention is directed to a winder apparatus including an improved arrangement for effecting web transfer, which not only desirably precludes inadvertent mis-transfers, which is also desirably straightforward in configuration for economical manufacture and use.

SUMMARY OF THE INVENTION

The present invention is directed to a winder apparatus for winding webs of materials into coreless rolls, with the apparatus including an improved arrangement for effecting transfer of the webs onto associated winding spindles for initiating winding thereon. The apparatus includes a rotatably driven transfer brush assembly positioned in operative association with an apparatus conveyor and the winding spindles, with the brush assembly configured to engage the leading edge portion of one of the webs, and thereby deflect and transfer the web from the conveyor onto the associated winding spindle to initiate winding. The arrangement is desirably straight forward in construction for economical manufacture and use, with highly consistent and reliable web-transfer achieved.

In accordance with the illustrated embodiment, the present winder apparatus includes a conveyor for serially conveying webs of material to be wound into rolls. Typically, such webs comprise bags formed from plastic film material, which may be arranged in interleaved relationship, or in end-to-end array.

The apparatus includes an indexable winding turret having a plurality of winding spindles thereon. The turret is indexable to position each of the spindles in a transfer position, in operative association with, and generally transversely of, the conveyor on which the webs are moved.

In accordance with the present invention, the winder apparatus includes a rotatably driven transfer brush assembly positionable in operative association with the web conveyor, generally transversely thereof. The transfer brush assembly includes at least one rotatable brush wheel, which is rotatable in a direction opposite to that direction in which the webs of material are conveyed by the associated conveyor, and at a speed equal to or faster than the liner speed of each web.

The brush wheel is engageable with one of the webs for transferring that one of the webs onto one of the spindles when it is in the transfer position. By this action, winding of the web onto the spindle is initiated, with the spindle being rotatably driven at a speed coordinated with the speed at which the webs are being conveyed. In the preferred embodiment, each of the winding spindles includes air passageways, with application of vacuum through these passageways facilitating initiation of winding, and the direction of air pressure outwardly through the passageways facilitating discharge of a completed roll from the spindle after the turret is indexed to present the roll at a discharge position.

In accordance with a presently preferred embodiment, the transfer brush assembly includes a plurality of the brush wheels positioned in spaced apart relationship. The apparatus further preferably includes a plurality of spaced apart guide fingers which are positionable generally about the one of the winding spindles in the transfer position. The brush wheels are each positioned between a respective adjacent pair of the guide fingers, with the guide fingers and transfer brush assembly preferably mounted for movement together on a movable frame which can be brought into operative association with a winding spindle at the transfer position after indexed movement of the associated winding turret.

In the preferred form, the apparatus includes a support roll positioned beneath the conveyor for cooperation with the transfer brush assembly, thereby facilitating transfer of each of the webs from the conveyor onto the associated winding spindle.

Other features and advantages of the present invention will become readily apparent from the following detailed description, the accompanying drawings, and the appended claims.

DETAILED DESCRIPTION

Figure 1:
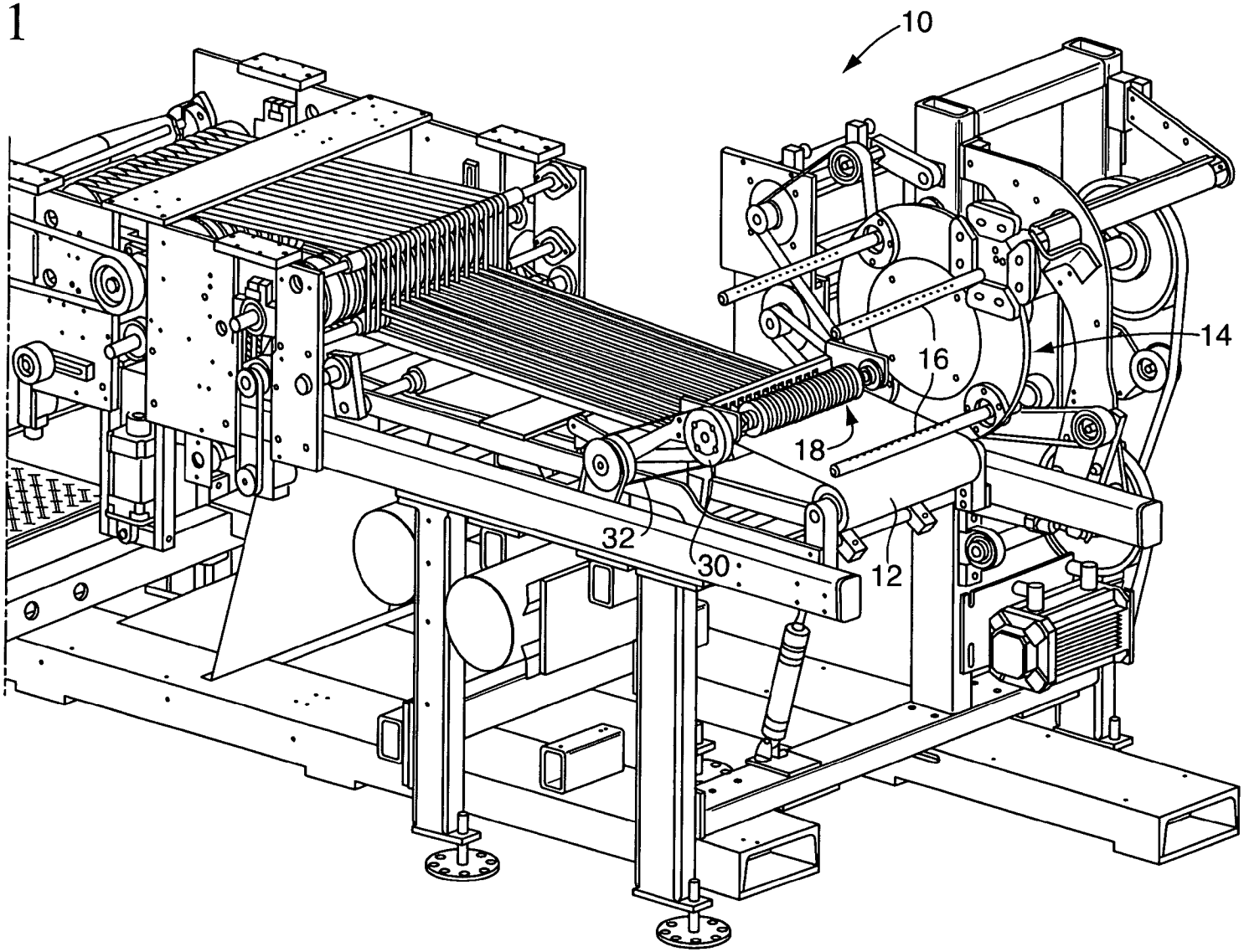
FIG. 1 is a diagrammatic, perspective view of a winder apparatus including a transfer brush assembly embodying the principles of the present invention.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

With reference first to FIG. 1, therein is illustrated a winder apparatus 10 embodying the principals of the present invention. As will be recognized by those familiar with the art, winder apparatus 10 is configured to wind webs of material, typically plastic film bags arranged in an interleaved relationship or end-to-end arrays, into individual, coreless rolls. After winding into individual rolls, the rolls are discharged from the apparatus for subsequent handling.

Winder apparatus 10 includes a frame on which a conveyor 12 is mounted for serially conveying the webs of material therealong. The apparatus further includes a selectively indexable, winding turret 14 having a plurality of winding spindles 16 mounted thereon. Winding turret 14 is indexed during operation of apparatus 10 so that each of the winding spindles 16 thereon are moved through four distinct positions. These include a transfer position, at which the spindle is positioned in operative association with conveyor 12 for initiating winding of a roll of material thereon. In a final wind position, winding of the roll of material is completed. In a discharge position, the roll of wound material is ejected from the spindle. Finally, each spindle is indexed through a ready position, prior to being indexed to the transfer position, before repeating the cycle.

In accordance with the present invention, efficient and consistent transfer of a leading edge portion of one of the webs of material to the associated spindle in the transfer position is effected by the provision of a transfer brush assembly 18. The transfer brush assembly 18 is positionable in operative association with the conveyor 12, and one of the spindles 16 in the transfer position thereof, to thereby effect transfer of a leading edge portion of one of the webs of material being conveyed onto the spindle in the transfer position to thereby initiate winding into a roll.

The transfer brush assembly comprises at least one, and preferably a plurality of generally circular brush wheels 20 positioned in spaced apart relationship along a mounting shaft 22. In a current embodiment, each of the rotatable brush wheels 20 has a three inch diameter, a face width of approximately 0.5 inches, with 16 mil bristles, such as commercially available from Brush Research Manufacturing, under designation CN-3. The brush wheels are spaced apart on the shaft 22 by the provision of suitable rubber donut-shaped spacers (not shown) positioned along the shaft, and are thus rotatable together about an axis extending transversely of the conveyor.

The brush wheels 20 of the transfer brush assembly are positionable in operative association with the conveyor 12 so as to be engageable with the conveyor, and thus engageable with a leading edge portion of one of the webs of material being conveyed thereon. Transfer of the web to the associated spindle 16 in its transfer position is facilitated by rotatably driving the transfer brush assembly in a direction opposite to the direction of movement of the webs of material, that is, in a clockwise direction referring to the orientation of FIG. 3.

Figure 2:
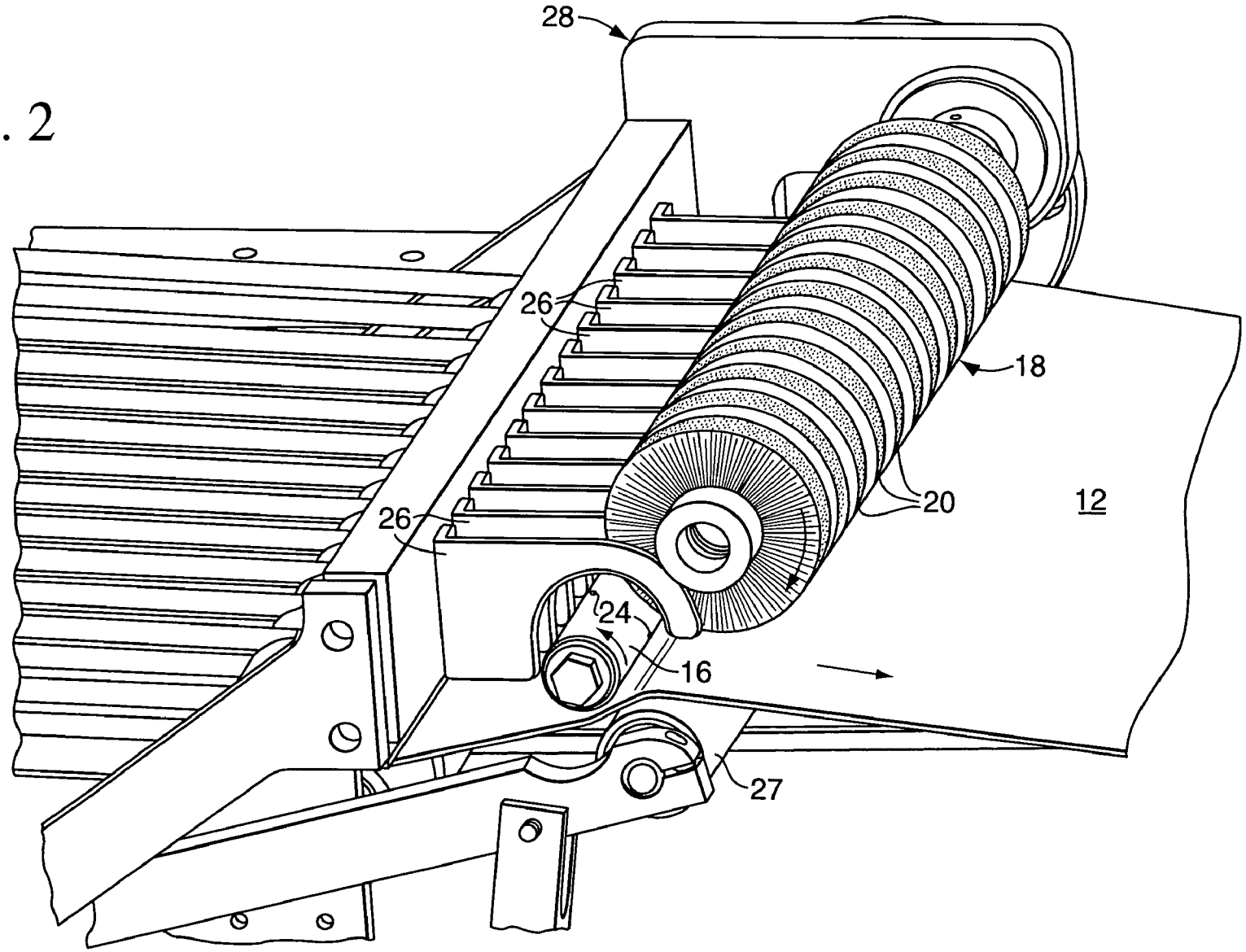
FIG. 2 is a relatively enlarged, diagrammatic view illustrating the transfer brush assembly of the present invention.
Figure 3:
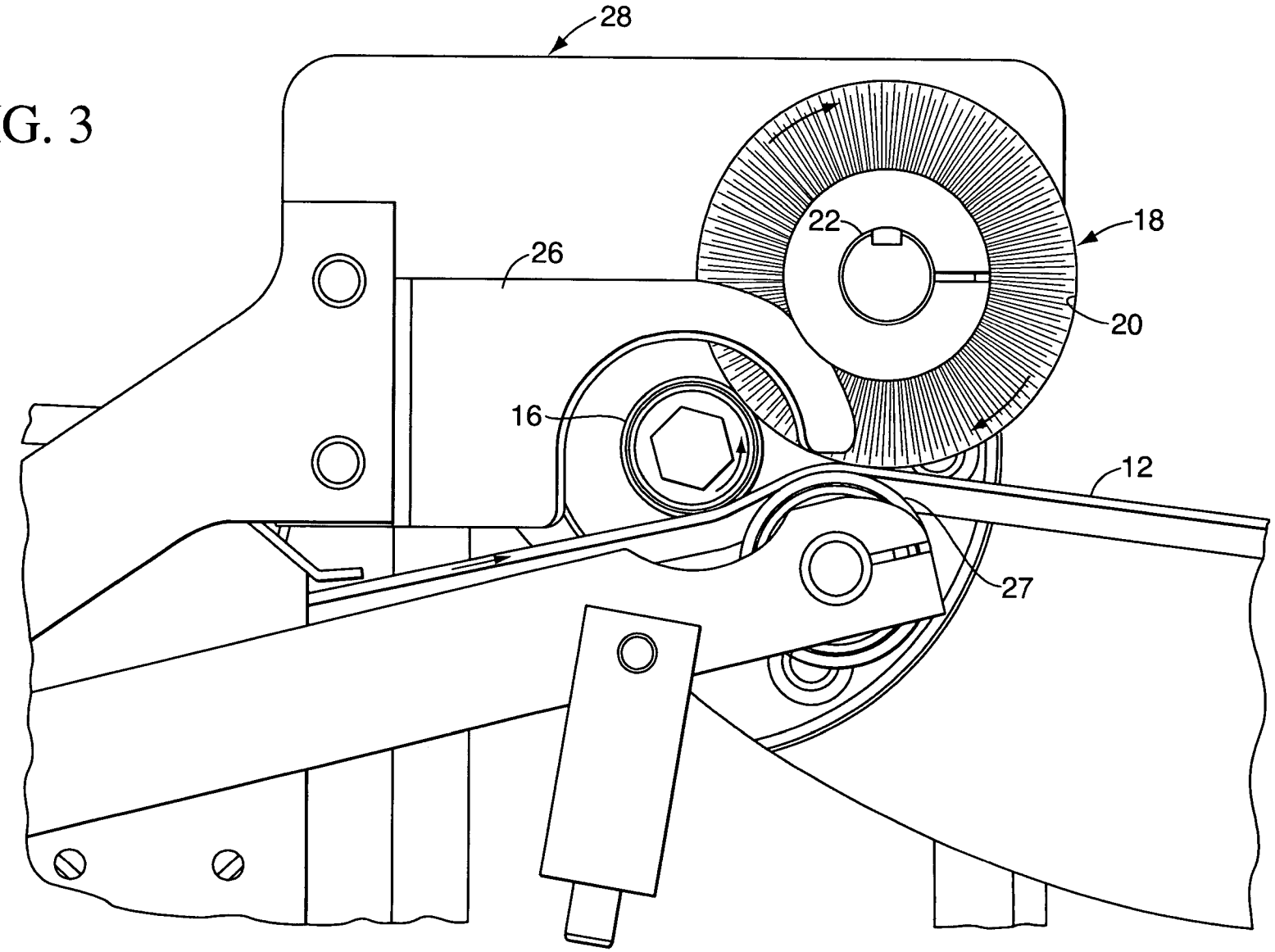
FIG. 3 is a diagrammatic, side elevational view of the transfer brush assembly of the present invention.

With particular reference to FIG. 3, one of the transfer spindles 16 is shown in its transfer position, with the spindle being rotatably driven in a direction opposite to the direction of rotation of transfer brush assembly 18 (i.e., spindle 16 is driven in a counter-clockwise direction, referring to the orientation of FIG. 3). As a web of material to be transferred is urged and displaced off of conveyor 12 by engagement of the brush wheels 20 therewith, the leading edge portion of the web is urged generally upwardly and about the rotating spindle 16. In the preferred embodiment, each of the spindles 16 defines a plurality of air passageways 24 (FIG. 2) at the periphery thereof. During web transfer, a vacuum is created at these air passageways in order to facilitate initiation of winding of the web of material on the spindle. During subsequent discharge of the coreless roll, after each spindle has been indexed to its discharge position, positive air pressure is directed through these passageways to facilitate discharge of the roll from the spindle.

In order to further facilitate initiation of winding of each web on a spindle in the transfer position, the winder apparatus includes a plurality of guide fingers 26 positionable in operative association with the spindle in the transfer position. As best illustrated in FIG. 2, the spaced apart brush wheels 20 are each positioned between a respective pair of the guide fingers 26, with the guide fingers 26 extending generally about the one of the spindles 16 in the transfer position as winding is initiated. The guide fingers thus act to guide the leading edge portion of the web onto the spindle, as transfer is effected by the rotating transfer brush assembly 18.

To facilitate transfer of the web by the action of transfer brush assembly 18, the winder apparatus can include a support roll 27 positioned beneath the conveyor generally opposite the brush assembly. The support roll cooperates and coacts with the brush assembly to urge each web off of the conveyor for transfer to the associated winding spindle The support roll can be mounted for movement, if desired, to permit the support roll to be periodically urged upwardly toward the brush assembly to promote engagement of the brush assembly with the web to be transferred. The support roll can thus be configured to function as a so-called kick roll, and operated in conjunction with the transferring action of the brush assembly, to promote consistent web transfer.

During indexed movement of the winding turret 14, for indexing the winding spindles 16 through each of their four positions, transfer brush assembly 20, and the associated guide fingers 26, are moved to an out-of-the-way disposition, to thereby facilitate unencumbered indexing rotation of the winding turret 14. To this end, the brush wheel assembly and guide fingers are mounted on a movable frame 28 for movement together relative to the one of the spindles in the transfer position. FIGS. 2 and 3 illustrate the movable frame 28, with guide fingers 26 and transfer brush assembly 18, positioned in such operative association with the illustrated spindle 16. Prior to indexing rotation of the turret 14, the frame 28 is pivoted generally upwardly in a counterclockwise direction by one or more appropriate actuators, preferably a pair of pneumatic cylinders. The first of the pneumatic cylinders effects the major portion of the motion of movable frame 28, while a second one of the cylinders urges the frame, and transfer roller 18, into position for operative engagement with the conveyor 12, and the associated spindle 16 in its transfer position.

FIG. 1 illustrates a drive arrangement for the rotatably driven transfer brush assembly 18, including a drive pulley 30, and a drive belt 32. The transfer brush assembly is appropriately driven at a speed which is equal to, or faster than, the linear speed of the web of material being conveyed on conveyor 12. The orientation of the transfer brush assembly, including brush wheels 20, is such that the brush wheels are in contact with the conveyor and the spindle 16 simultaneously, so that the resulting sweeping action of the brush wheels effects a positive transfer up from the conveyor onto the spindle 16. The preferred provision of curved guide fingers 26 extending generally about the spindle 16 desirably acts to ensure that the web travels around the spindle during transfer.

After transfer is completed and winding initiated, the movable frame 28 can be pivoted for moving the transfer brush assembly 18 and the associated guide fingers 26 out of their operative position. The turret 14 is indexed to move the rotating spindle 16 to its final wind position to complete roll formation.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A winder apparatus for winding webs of material into rolls, comprising:

a conveyor for serially conveying said webs of material;

a selectively indexable turret having a plurality of winding spindles thereon, said turret being indexable to position each one of said spindles in a transfer position in operative association with said conveyor for initiating winding of each one of said webs of material on a respective one of said spindles in said transfer position; and a transfer brush assembly positionable in operative association with said conveyor, said brush assembly being engageable with each said one of said webs of material for transferring said one of said webs onto the respective one of said spindles in said transfer position, wherein said brush assembly comprises at least one rotatable brush wheel, said rotatable brush wheel rotating in a direction opposite to that direction in which said one of said webs is conveyed by said conveyor.

2. A winder apparatus in accordance with claim 1, wherein:

said brush assembly comprises a plurality of generally circular brush wheels rotatable together about an axis extending transversely of said conveyor.

3. A winder apparatus in accordance with claim 2, wherein:

said apparatus includes a plurality of guide fingers positionable generally about said one of said spindles in said transfer position, said plurality of brush wheels being spaced apart and each positioned between a respective adjacent pair of said guide fingers.

4. A winder apparatus in accordance with claim 3, wherein:

said brush assembly and said guide fingers are mounted on a frame for movement together relative to the one of said spindles in said transfer position.

5. A winder apparatus for winding webs of material into rolls, comprising:

a conveyor for serially conveying said webs of material;

an indexable turret having a plurality of winding spindles thereon, said turret being indexable to position each one of said spindles in a transfer position in operative association with and generally transversely of said conveyor for initiating winding of each one of said webs of material on a respective one of said spindles in said transfer position; and a transfer brush assembly positionable in operative association with said conveyor generally transversely thereof, said transfer brush assembly including at least one rotatable brush wheel rotatable in a direction opposite to that direction in which said webs of material are conveyed, said brush wheel being engageable with each one of said webs of material for transferring each said one of said webs of material onto said respective one of said spindles in said transfer position.

6. A winder apparatus in accordance with claim 5, wherein:

said brush wheel is engageable with said one of said spindles in said transfer position.

7. A winder apparatus in accordance with claim 5, wherein:

said transfer brush assembly includes a plurality of said rotatable brush wheels.

8. A winder apparatus in accordance with claim 7, wherein:

said apparatus includes a plurality of guide fingers positionable generally about said one of said spindles in said transfer position, said plurality of brush wheels being spaced apart and each positioned between a respective paid of said guide fingers, said apparatus including a movable frame of which said guide fingers and said transfer brush assembly are mounted for movement together relative to the one of said spindles in said transfer position.

9. A winder apparatus in accordance with claim 5, wherein:

each of said spindles defines a plurality of air passageways at the periphery thereof.

10. A winder apparatus in accordance with claim 5, including:

a support roll positioned beneath said conveyor for cooperation with said brush assembly to facilitate transfer of each of said webs.

11. A winder apparatus for winding webs of material into rolls, comprising:

a conveyor for serially conveying said webs of material;

a selectively indexable turret having a plurality of winding spindles thereon, said turret being indexable to position each one of said spindles in a transfer position in operative association with said conveyor for initiating winding of each one of said webs of material on a respective one of said spindles in said transfer position; and a transfer brush assembly positionable in operative association with said conveyor, said brush assembly being engageable with said each one of said webs of material for transferring said one of said webs onto the respective one of said spindles in said transfer position, wherein said brush assembly comprises a plurality of generally circular brush wheels rotatable together about an axis extending transversely of said conveyor, and said apparatus including a plurality of guide finders positionable generally about said one of said spindles in said transfer position, said plurality of brush wheels being spaced apart and each positioned between a respective adjacent pair of said guide fingers.

12. A winder apparatus in accordance with claim 11, wherein:

said brush assembly and said guide fingers are mounted on a frame for movement together relative to the one of said spindles in said transfer position.

* * * * *